US005507513A

United States Patent [19]

Peters et al.

[11] Patent Number: 5,507,513

[45] Date of Patent: Apr. 16, 1996

[54] MULTI-TERRAIN WHEELCHAIR

[76] Inventors: Bryan T. Peters, 1116 Elkins Dr., Auburn, Ala. 36830; Christopher J. Arnold, P.O. Box 2867, Auburn, Ala. 36831

[21] Appl. No.: 374,208

[22] Filed: Jan. 18, 1995

[51] Int. Cl.[6] ..... A61G 5/00

[52] U.S. Cl. ..... 280/250.1; 280/304.1

[58] Field of Search ..... 280/250.1, 304.1

[56] References Cited

U.S. PATENT DOCUMENTS

| | | | |
|---|---|---|---|
| 3,644,450 | 5/1972 | Udden et al. . | |
| 4,078,817 | 3/1978 | Ferguson et al. . | |
| 4,310,167 | 1/1982 | McLaurin . | |
| 4,436,320 | 3/1984 | Brudermann et al. . | |
| 4,566,707 | 1/1986 | Nitzberg . | |
| 5,020,818 | 6/1991 | Oxford . | |
| 5,149,118 | 9/1992 | Oxford . | |
| 5,333,894 | 8/1994 | Mayes | 280/304.1 |
| 5,356,172 | 10/1994 | Levy et al. | 280/250.1 |
| 5,409,247 | 4/1995 | Robertson et al. | 280/250.1 |

FOREIGN PATENT DOCUMENTS

| | | |
|---|---|---|
| 1503807 | 8/1989 | U.S.S.R. . |
| 1505544 | 9/1989 | U.S.S.R. . |
| 1561979 | 5/1990 | U.S.S.R. . |
| 1732978 | 5/1992 | U.S.S.R. . |

*Primary Examiner*—Mitchell J. Hill
*Attorney, Agent, or Firm*—Richard C. Litman

[57] ABSTRACT

A multi-terrain wheelchair which has numerous features to provide for high degrees of maneuverability, versatility, comfort, convenience, and stability. The wheelchair has a suspension system in which a swing arm is attached to a rear camber tube and rear axle assembly. The swing arm pivots about an upward protrusion from the frame of the wheelchair. The swing arm meets resistance from a pneumatic cylinder, also attached to the frame. The pneumatic cylinder rather than the frame and the occupant absorbs any forces resulting from rough terrain. This suspension system results in a more comfortable ride and increases the versatility of the chair, in that it can traverse rough terrain with less impact on its occupant. The front wheel assembly of the wheelchair provides it with great maneuverability and stability. The large front wheels enable the chair to roll over any obstacle. Wheel stops and a linkage are provided between the front wheels. The back wheels are cambered for stability and to enable the occupant who is wheeling the chair to keep his hands clear of obstacles. An adjustable footrest and seat and a curved backrest increase comfort for the occupant. The removable seat and high mounted pushbars provide the wheelchair with great convenience as well.

20 Claims, 3 Drawing Sheets

MULTI-TERRAIN WHEELCHAIR

BACKGROUND OF THE INVENTION

1. Field of the Invention

The present invention relates to a multi-terrain wheelchair with a unique suspension system which reduces the jarring impact of bumps to the occupant.

2. Description of the Prior Art

The wheelchair provides a safe and comfortable mode of transportation for its occupant, as well as convenience for an lid attendant. A pneumatic shock absorbing system, a chair with a curved back, and an adjustable footrest and chair insure the occupant's comfort. Safety and maneuverability of the wheelchair are markedly improved over existing wheelchairs due to large front wheels which are linked together and prevented from completely pivoting. The camber of the rear wheels is yet another safety feature in that it allows the occupant's hands to clear any obstacles and increases stability. Curved, high-mounted pushbars are provided for the convenience of an attendant in pushing the wheelchair.

Following are previously patented inventions which disclose features relevant to the instant invention. These references lack many of the unique features that enable the versatility of the instant invention.

U.S. Pat. No. 3,644,450, issued May 23, 1972 to Per Edward Carl Udden et al., discloses a vehicle for outdoor use for disabled persons.

U.S. Pat. No. 4,078,817, issued Mar. 14, 1978 to Andrew Marvin Ferguson et al., a shock absorber attachment for a wheelchair.

U.S. Pat. No. 4,310,167, issued Jan. 12, 1982 to Colin A. McLaurin, discloses a wheelchair with a shock absorbing structure and a seat which can be moved forward.

U.S. Pat. No. 4,436,320, issued Mar. 13, 1984 to Uwe Brudermann et al., discloses a wheelchair chassis with left and right frames, which is designed to provide the advantages of independent wheel suspension.

U.S. Pat. No. 4,566,707, issued Jan. 28, 1986 to Leonard R. Nitzberg, discloses a wheel chair for ascending and descending stairways utilizing a strut, sprockets, and chains.

U.S. Pat. No. 5,020,818, issued Jun. 4, 1991 to Stuart G. Oxford, teaches an all-terrain wheelchair that is chain-driven and, optionally, track-driven.

U.S. Pat. No. 5,149,118, issued Sep. 22, 1992 to Stuart G. Oxford, discloses an all-terrain wheelchair with a frame constructed of tubular air-filed members to enable the wheelchair to be amphibious.

Soviet patent No. 1505544 A1 discloses a wheelchair of simpler construction with struts joined to the seat.

Soviet Patent No.'s 1503807 A1, 1561979 A1, and 1732978 A1 disclose wheelchairs for climbing stairs and for use in sports.

None of the above inventions and patents, taken either singly or in combination, is seen to describe the instant invention as claimed.

SUMMARY OF THE INVENTION

The wheelchair of the instant invention is provided with numerous unique features. The shock absorption system channels jolts due to rough terrain from the rear wheels to a swing arm assembly, which can pivot about an upward projection from the frame of the chair. Jolts transferred to the swing arm are opposed by the resistance of a pneumatic cylinder. The camber of the rear wheels allows the occupant's hands to remain closer to the chair (when propelling the chair) and be out of the way of any obstacles. The camber also increases the stability of the chair. The wheelchair is also equipped with an adjustable footrest and an adjustable and removable seat with high-mounted pushbars for comfort and convenience. The large front wheels allow the wheelchair to roll over most obstacles. Further, the linkage between the wheels and their provision with wheel stops increases the maneuverability and stability of the wheelchair.

Accordingly, it is a principal object of the invention to provide a multi-terrain wheelchair with a pneumatic suspension system which absorbs the impact of rough terrain.

It is another object of the invention to provide a multi-terrain wheelchair with large front wheels capable of rolling over obstacles.

It is a further object of the invention to provide a wheelchair with front wheels that are linked together and that have wheel stops for enhanced safety and control.

Still another object of the invention is to provide rear wheels that are cambered so that the hands of the occupant, while powering the chair, are out of the path of any danger. Additionally this camber increases stability of the wheelchair.

Still a further object of the invention is to provide a chair that is both adjustable and removable and has a curved backrest for increased comfort.

Even another object of the invention is to provide a wheelchair with high pushbars so that an attendant can easily push the wheelchair.

Yet another object of the invention is to provide a wheelchair with an adjustable footrest.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
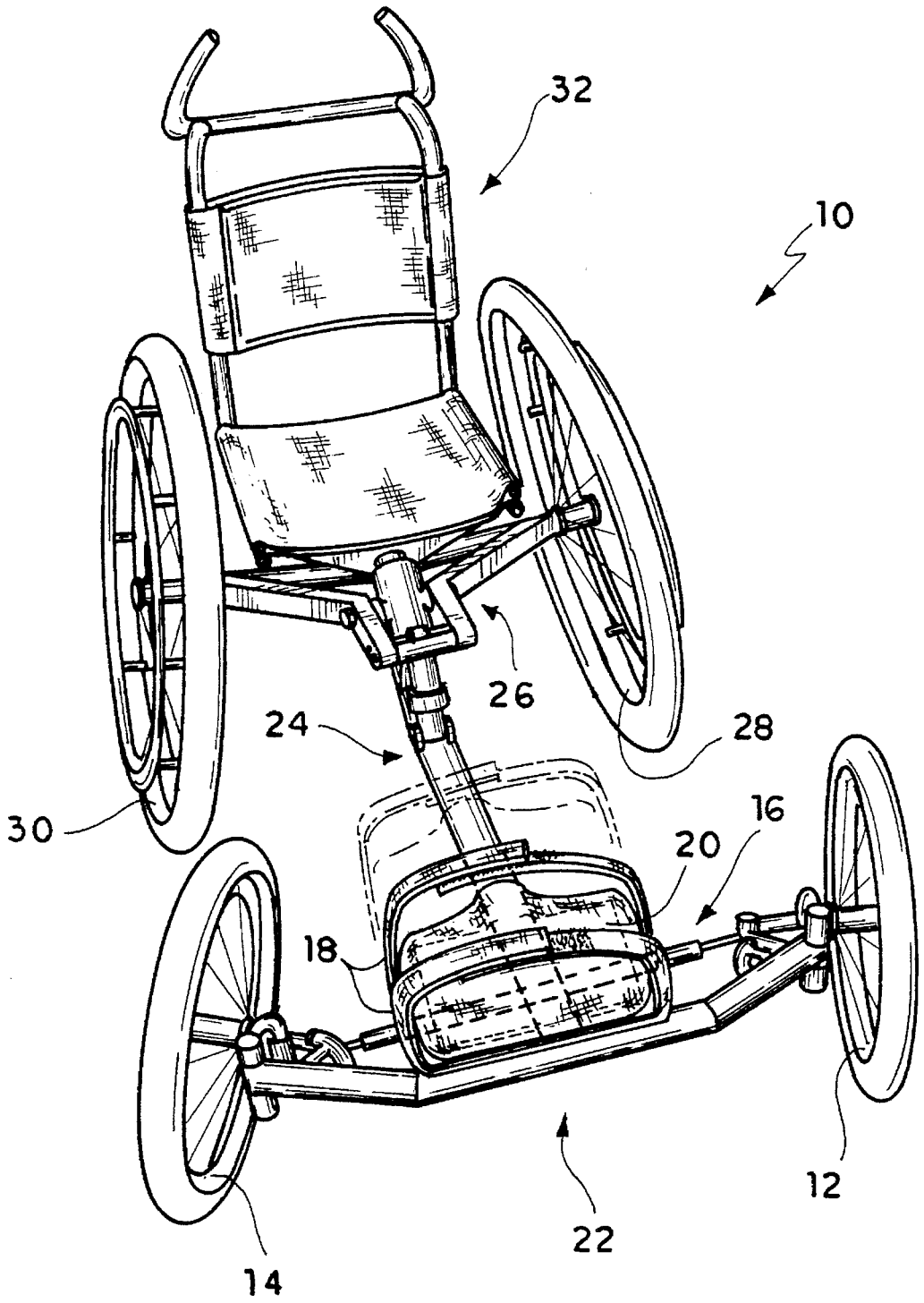
FIG. 1 is a front perspective view of the multi-terrain wheelchair.

The present invention relates to a multi-terrain wheelchair 10 having many features to facilitate its use as such. Referring to FIG. 1, the multi-terrain wheelchair 10 has a front wheel assembly 22 (discussed below in conjunction with FIGS. 2 and 3), a tubular frame assembly 24 (as will be described below in connection with FIG. 3), a rear wheel assembly 26 (discussed with FIG. 4), and a chair assembly 32 (detailed in FIG. 5). The footrest 16 is also seen in FIG. 1. The footrest 16 includes footstraps 18 and a stiffener plate 20, preferably made of metal. The footrest 16 is adjustable, by the use of a strap (not shown) around the main frame member 74 to insure the comfort of the occupant of the wheelchair 10.

Figure 2:
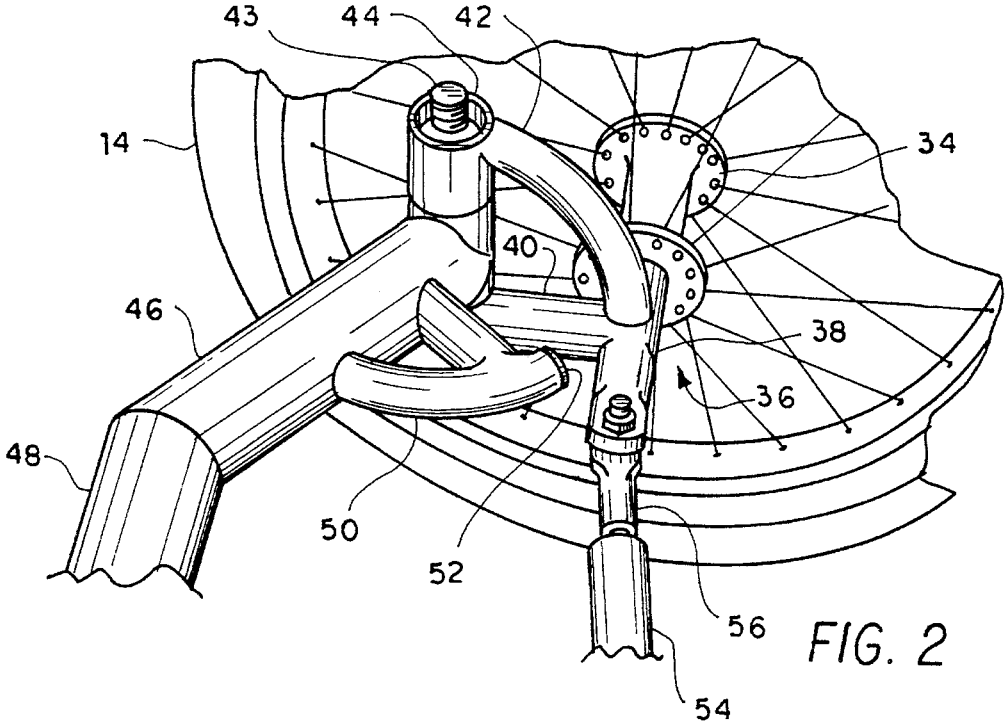
FIG. 2 is a fragmentary perspective view of the front wheel assembly of the multi-terrain wheelchair, showing the details of the right side.
Figure 3:
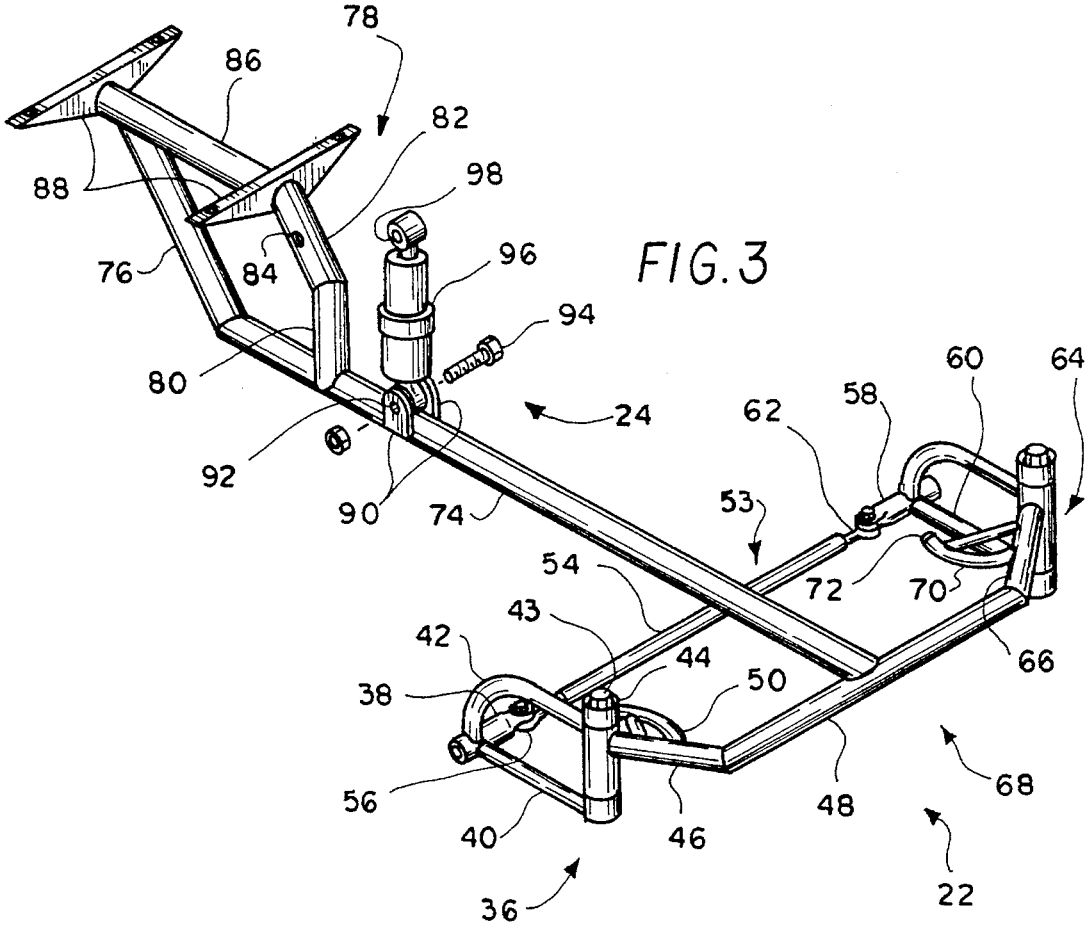
FIG. 3 is a perspective view of the front wheel assembly, with the front wheels removed, and the frame assembly of the multi-terrain wheelchair.

Referring to FIGS. 2 and 3, the specifics of the front wheel assembly 22 and the tubular frame assembly 24 can be seen. The front wheel assembly 22 includes left and right front wheels 12 and 14 (shown in FIG. 1), left and right steering caster assemblies 64 and 36, a front camber tube assembly 68, and a linkage assembly 53. The front wheels 12 and 14 are large, preferably on the order of 16 inches in diameter, so that the wheelchair 10 can easily roll over obstacles. The right steering caster assembly 36 includes a portion 38 which is perpendicular to the right front wheel 14 and extends inwardly from the hub 34 of the wheel 14. This perpendicular portion 38 is connected to both the linkage assembly 53 and the front camber tube assembly 68. This connection to both of these assemblies provides a greater degree of stability than found in ordinary wheelchairs, a significant fact when one considers the conditions in which a multi-terrain wheelchair may be used. The perpendicular portion 38 is connected to the front camber tube assembly 68 by a portion 40, which is parallel to the right front wheel 14, and extends forwardly from the perpendicular portion 38. A curved portion 42 of the right steering caster assembly 36 extends, upwardly and inwardly, in an arcuate fashion from the perpendicular portion 38. This curved portion 42, which is in a plane parallel to the right front wheel 14, terminates in a right steering turn axle stub 42 at its uppermost end. The turn axle stub 44 is pivotally connected to a right portion 46 of the camber tube assembly 68 and the parallel portion 40 of the right steering caster assembly 36 by a right steering turn axle 43 to form a right steering pivot.

The right portion 46 of the front camber tube assembly 68 extends inwardly and forwardly from the right steering pivot. The right portion 46 of the front camber tube assembly 68 is connected to a center portion 48, which is connected to a left portion The left portion 66 of the front camber tube assembly 68 is identical to the right portion 46 of the front camber tube assembly 68. The left portion 66 is attached to a left steering caster assembly 64, which is identical to the previously-described right steering caster assembly 36. It should be understood that the depiction of the left steering caster assembly 64 shows parts of the assembly of exaggerated lengths for illustrative purposes so all detail can be shown. The right and left portions 46 and 66 of the front camber tube assembly 68 each have a wheel stopper 50 and 70 extending arcuately from a point at approximately their centers toward the respective steering caster parallel portion 40 and 60. The right and the left wheel stoppers 50 and 70 have rubber plugs 52 and 72 in their ends.

The connection of the right steering caster assembly 36 to the linkage assembly 53 is achieved by a right wheel link 56, which is connected to the right steering caster perpendicular portion 38 at one end and a linkage rod 54 at the other. The other end of the linkage rod 54 is connected to a left wheel link 62 which is connected to a perpendicular portion 58 of the left steering caster assembly 64. By this linkage, the two front wheels 12 and 14 are linked together and operate interdependently. Additionally the two front wheels are connected by the front camber tube assembly Because of these connections and the wheel stoppers 50 and 70, which limit the turning of the wheels, the wheelchair 10 is far more maneuverable and stable than many prior wheelchairs.

The tubular frame assembly 24 can also be seen in FIG. 3. The frame assembly 24 includes a main frame member 74 extending rearwardly from the center of the center portion 48 of the front camber tube assembly. The main frame member 24 includes a seat support 76, a swing arm support member 78, a frame shock mount and a shock dampening mechanism 96. The seat support 76 extends upwardly and rearwardly from the rear end of the main frame member 74.

The swing arm support member 78 includes a first, upwardly-extending portion 80 from which a second portion 82 extends rearwardly and upwardly. The second portion 82 is connected, at its opposite end, to a seat tube 86, from which a seat mount 88 upwardly extends.

Two tabs extending upwardly form the main frame member 24 form the shock mount 90. The dampening mechanism 96, preferably a pneumatic cylinder, is attached to and extends upwardly from the shock mount 90. The attachment is facilitated by a latching device 94, preferably a bolt, inserted through holes 92 in the tabs of the frame shock mount 90 and in the lower end of the shock dampening mechanism 96.

Figure 4:
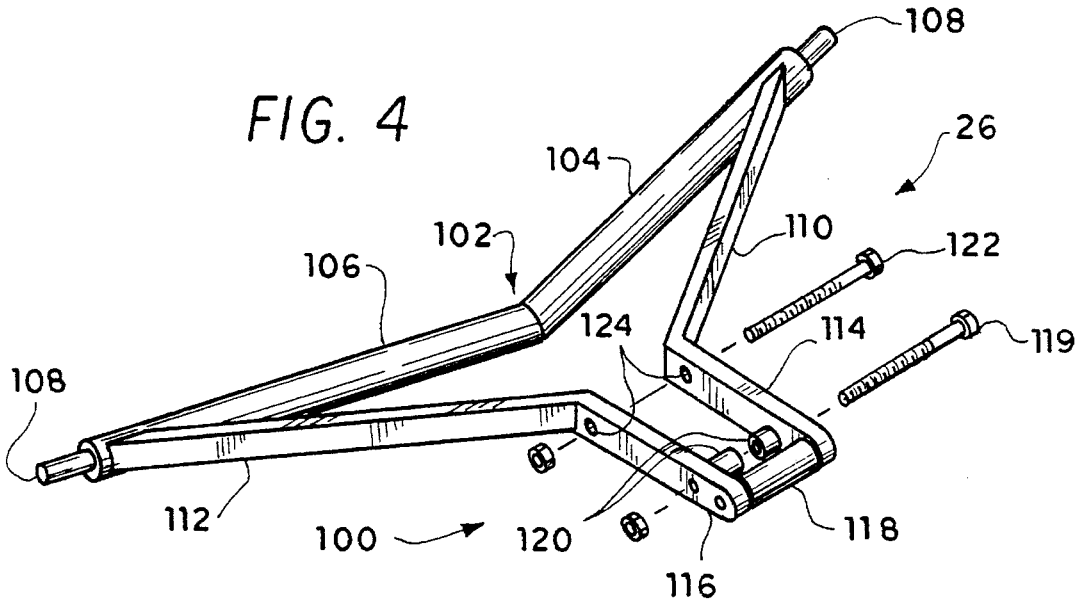
FIG. 4 is a partially exploded perspective view of the rear wheel assembly of the multi-terrain wheelchair, with the rear wheels removed.

The rear wheel assembly 26 is shown in FIG. 4 (with the exception of the rear wheels). The rear wheel assembly 26 includes left and right rear wheels 28 and 30 connected by a rear linkage, which may be a rear axle 108, and a swing arm 100. Preferably, the rear axle 108 is mounted in a rear camber tube assembly 102. The rear camber tube 102 includes left 104 and right 106 portions. These camber tube portions 104 and 106 extend downwardly and meet in a "V" type configuration. Because of this configuration, the axle 108 is angled such that the rear wheels 28 and 30, which rotate about the axle 108, have a camber. The camber is such that the upper portion of the rear wheels 28 and 30 are farther in than the lower portion of the rear wheels 28 and 30. This camber allows the occupant to position his hands along the upper portion of the wheels 28 and 30 (to push the wheelchair 10) without extending them further out than the lower portion of the wheels 28 and 30; thus avoiding his hands hitting any obstacles.

The swing arm assembly 100 includes a left and a right arm assembly. Each arm assembly is attached to the axle 108 and extends upwardly and forwardly, enveloping the second portion 82 of the swing arm support member 78 and the upper end of the shock dampening mechanism 96. The forward ends of the arm assemblies are spaced apart by a spreader bar 118. A swing arm pivot is formed by inserting a locking device 122 through holes 124 in each arm assembly and a hole 84 in the second portion 82 of the swing arm support member 78. The swing arm assemblies include swing arm shock mount 120, 120, which are projections extended inwardly from each arm assembly (see FIG. 4). The shock dampening mechanism is attached to the arm assemblies by a locking device 119 inserted through holes in the projections and a hole 98 in the top of the shock dampening mechanism 96.

Preferably, the left arm assembly includes a left shock arm 110, extending forwardly and inwardly from a point along the axle 108 near the left rear wheel 28, and a left pivot arm 114. Similarly, the right arm assembly includes a right shock arm 112 and a right pivot arm 116. The attachments to the frame, i.e. to the second portion 82 of the swing arm support member 78 and the shock dampening mechanism 96, are made at the pivot arms 114 and 116 in this preferred embodiment. Further, the spreader bar is attached at the forward ends of the pivot arms 114 and 116.

When the rear wheels 28 and 30 pass over an obstacle, the upward force on the wheels causes the swing arm 100 to pivot about the swing arm pivot and provide a downward force to the shock dampening mechanism 96. This downward force is absorbed by the shock dampening mechanism 96 and none of the jolt is transferred to the main frame member 74. This shock absorbing system decreases the impact of jolts to the occupant, thereby increasing the comfort and the versatility of the wheelchair 10.

Figure 5:
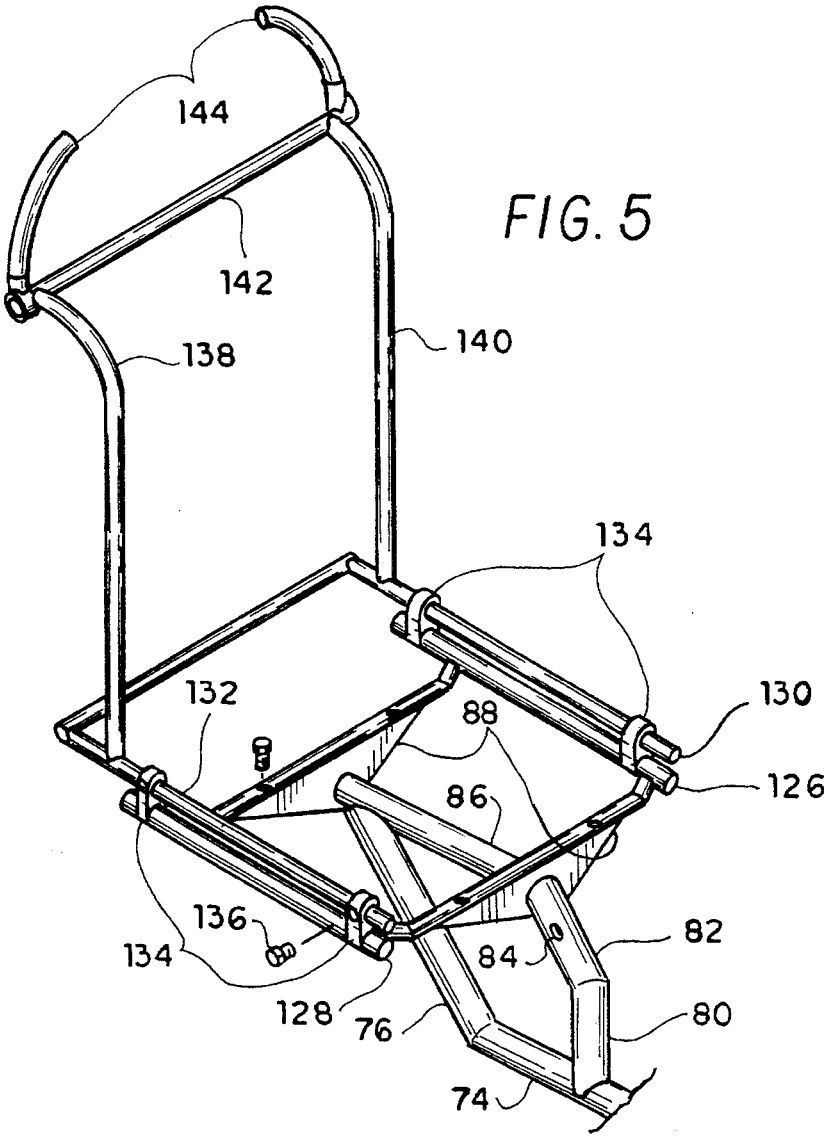
FIG. 5 is a perspective view of the chair assembly of the multi-terrain wheelchair, showing its attachment to the frame.

As best seen in FIG. 5, the chair assembly 32 includes left and right seat racks 126 and 128 mounted onto the seat mount A chair frame is attached to the seat racks 126 and 128 by sleeves 134 attached to the seat racks 126 and 128 and a left and right horizontal portion 130 and 132 of the chair frame. The chair frame also includes a pair of tubular seat back members 138 and 140 extending upwardly from a point near the rear of the horizontal portions 130 and 132. The seatback members 138 and 140 are curved for comfort and are attached to each other at their upper ends by seat back top 142. A pushbar 144 extends arcuately upwardly and inwardly from either end of the seat back top 142. This high-mounted pushbar is convenient for an attendant pushing the wheelchair 10. Another feature which provides convenience (also comfort and versatility) to the wheelchair 10 is the adjustability and removability of the chair frame. The horizontal portions and 132 of the chair frame are held in the sleeves 134 by set screws 136. Upon loosening these screws 136 the chair frame can slide with respect to the seat racks 126 and 128. Sliding of the chair frame allows it to be adjusted, by retightening the set screws 136 at a different point, or removed and replaced with another chair frame. Material is stretched across the horizontal portions 130 and 132 and the back portions 138 and 140; the completed chair is seen in FIG. 1.

It is to be understood that the present invention is not limited to the sole embodiment described above, but encompasses any and all embodiments within the scope of the following claims.

We claim:

1. A wheelchair comprising;

at least one front wheel, said at least one front wheel being rotatably mounted so that it can rotate;

a frame extending rearwardly from said at least one front wheel, said frame including a shock-dampening mechanism, a swing arm pivot, and a seat support member;

a rear wheel assembly including:

a left and a right rear wheel, said wheels connected by a rear linkage;

a swing arm pivotally attached to said swing arm pivot of said frame, said swing arm including:

a left and a right arm assembly, each of said arm assemblies having a forward end and a rear end, said rear end of said each of said arm assemblies extending from said rear linkage;

means for attachment of said arm assemblies with said shock dampening mechanism of said frame; and, means for pivotally attaching said arm assemblies to said swing arm pivot of said frame.

2. The wheelchair of claim 1 wherein said attachment of said arm assemblies with said shock dampening mechanism includes a latching device passing through a hole in said left arm assembly, a hole in the upper part of said shock dampening mechanism, and a hole in said right arm assembly.

3. The wheelchair of claim 2 wherein said arm assemblies are pivotally attached to said swing arm pivot of said frame by a latching device passing through a hole in said left arm assembly, a hole in said swing arm pivot of said frame, and a hole in said right arm assembly.

4. The wheelchair of claim 1 wherein said left arm assembly includes a left shock arm, a left pivot arm, a right shock arm, and a right pivot arm, said left shock arm extending forwardly from said rear linkage and said left pivot arm extending forwardly from said left shock arm, said right shock arm extending forwardly from said rear linkage and said right pivot arm extending forwardly from said right shock arm.

5. The wheelchair of claim 4 wherein said attachment of said arm assemblies with said shock dampening mechanism includes a latching device passing through a hole in said left pivot arm, a hole in the upper part of said shock dampening mechanism, and a hole in said right pivot arm, and wherein said arm assemblies are pivotally attached to said swing arm pivot of said frame by a latching device passing through a hole in said left pivot arm, a hole in said swing arm pivot of said frame, and a hole in said right pivot arm.

6. The wheelchair of claim 5 wherein said attachment of said arm assemblies with said shock dampening mechanism further includes a pivot arm shock mount including an inward projection from each of said pivot arms, said upper end of said shock dampening means attached to said projections by a latching device extended through holes in said upper end of said shock dampening means and said holes in said projections.

7. The wheelchair of claim 6 further comprising a spreader bar extending between said front end of said left pivot arm and said front end of said right pivot arm.

8. The wheelchair of claim 7 wherein said left shock arm extends inwardly and forwardly from a portion of said rear linkage near said left rear wheel, and said right shock arm extends inwardly and forwardly from a portion of said rear linkage near said right rear wheel.

9. The wheelchair of claim 8 wherein said shock dampening mechanism is a pneumatic cylinder.

10. The wheelchair of claim 1 wherein said left arm assembly extends inwardly and forwardly from a portion of said rear linkage near said left rear wheel, and said right arm assembly extends inwardly and forwardly from a portion of said rear linkage near said right rear wheel.

11. A wheelchair comprising;

a front wheel assembly including:

a left and a right front wheel, said wheels connected together by a front linkage;

a right and a left steering caster connected to said left and right front wheels;

a frame extending rearwardly from said front wheel assembly, said frame including a shock-dampening mechanism, a swing arm pivot, and a seat support member;

a rear wheel assembly including:

a left and a right rear wheel, said wheels connected by a rear linkage;

a swing arm pivotally attached to said swing arm pivot of said frame, said swing arm including:

a left and a right arm assembly, each of said arm assemblies having a forward end and a rear end, said rear end of said each of said arm assemblies extending from said rear linkage;

means for attachment of said arm assemblies with said shock dampening mechanism of said frame; and, means for pivotally attaching said arm assemblies to said swing arm pivot of said frame.

12. The wheelchair of claim 11 wherein said front wheel assembly further includes a camber tube assembly, said camber tube assembly connected to said left and right casters.

13. The wheelchair of claim 12 wherein said camber tube assembly includes a center portion, a left portion, and a right portion, said left portion connected to and extending inwardly and forwardly from said left steering caster, said right portion connected to and extending inwardly and forwardly from said right steering caster, and said center portion extending between said left and right portions.

14. The wheelchair of claim 13 further including a left wheel stopper and a right wheel stopper, said left wheel stopper attached to said left portion of said camber tube and extending arcuately toward said left steering caster, said right wheel stopper attached to said right portion of said camber tube and extending arcuately toward said right steering caster.

15. The wheelchair of claim 14 wherein each said caster includes a perpendicular portion which extends inwardly and perpendicularly from a hub at the center of each said front wheel, a parallel portion which is parallel to each said front wheel, said parallel portion extending forwardly from said perpendicular portion, and a curved portion extending forwardly and upwardly from said perpendicular portion, said curved portion having a turn axle stub attached to its upper end.

16. The wheelchair of claim 15 wherein said shock dampening mechanism is a pneumatic cylinder.

17. The wheelchair of claim 11 wherein each said caster includes a perpendicular portion which extends inwardly and perpendicularly from a hub at the center of each said front wheel, a parallel portion which is parallel to each said front wheel, said parallel portion extending forwardly from said perpendicular portion, and a curved portion extending forwardly and upwardly from said perpendicular portion, said curved portion having a turn axle stub attached to its upper end.

18. A wheelchair having a front and back end and a left and right side, said wheelchair comprising:

a front wheel assembly including:

a left front wheel and a right front wheel, each said front wheel located at said front end of said wheelchair, said left front wheel located on said left side of said wheelchair, and said right front wheel located on said right side of said wheelchair;

a left steering caster assembly, said left steering caster assembly connected to the center of said left front wheel and including:

a left steering caster perpendicular portion which extends inwardly and perpendicularly from a hub at the center of said left front wheel;

a left steering caster parallel portion which is parallel to said left front wheel, said left steering caster parallel portion extending forwardly from said left steering caster perpendicular portion; and, a left steering caster curved portion extending forwardly and upwardly from said left steering caster perpendicular portion, said left steering caster curved portion having a turn axle stub attached to its upper end;

a right steering caster assembly, said right steering caster assembly connected to the center of said right front wheel and including:

a right steering caster perpendicular portion which extends inwardly and perpendicularly from a hub at the center of said right front wheel;

a right steering caster parallel portion which is parallel to said right front wheel, said right steering caster parallel portion extending forwardly from said right steering caster perpendicular portion; and, a right steering caster curved portion extending forwardly and upwardly from said right steering caster perpendicular portion, said right steering caster curved portion having a turn axle stub attached to its upper end;

a front camber tube assembly having:

a center portion having a left end and a right end, a left portion having a left end and a right end, said left end of said left portion pivotally attached to said turn axle stub and the front end of said parallel portion of said left steering caster to form a left steering pivot, said left portion including a left wheel stopper attached at the center of said left portion and extending arcuately toward said left steering caster parallel portion, said left wheel stopper having a rubber plug at its end;

a right portion having a left end and a right end, said right end of said right portion pivotally attached to said turn axle stub and the front end of said parallel portion of said right steering caster to form a right steering pivot, said right portion including a right wheel stopper attached at the center of said right portion and extending arcuately towards said right steering caster parallel portion, said right wheel stopper having a rubber plug at its end; and, said left and said right portions extending inwardly and forwardly such that they connect with said center potion at its left and right ends, said right end of said left portion connected to said left end of said center portion and said left end of said right portion connected to said right end of said center portion; and, a linkage assembly having a linkage rod, a left wheel link and a right wheel link, said linkage rod having a left end and a right end, each said wheel link having a left and a right end, said right end of said left wheel link connected to said left end of said linkage rod and said left end of said left wheel link connected to said perpendicular portion of said left steering caster, said left end of said right wheel link connected to said right end of said linkage rod and said right end of said right wheel link connected to said perpendicular portion of said right steering caster;

a tubular frame assembly including:

a main frame member having a forward and rear end, said forward end of said main frame member attached to and extending perpendicularly and rearwardly from the center of said center portion of said front camber tube assembly;

a seat support having an upper end and a lower end, said lower end of said seat supporting member attached to said rear end of said main frame member and extending diagonally upwardly and rearwardly therefrom;

a swing arm support member including:

a first portion with an upper and a lower end extending upwardly from said rear end of said main frame member;

a second portion with an upper and a lower end, said lower end of said second portion attached to said upper end of said first portion and extending rearwardly and upwardly, said second portion having a hole to receive a latching device;

a seat tube having a front and a rear end, said seat tube attached to said upper end of said second portion and extending rearwardly; and, a seat mount extending upwardly from said seat tube;

a frame shock mount which includes two tabs extending upwardly from said main frame member, each of said tabs having a hole for receiving a latching device; and, a pneumatic cylinder having an upper and a lower end, each end having a hole for extending a latching device therethrough, said lower end of said pneumatic cylinder being attached to said tabs by a latching device extended through said hole in said lower end of said pneumatic cylinder and said holes in said tabs;

a rear wheel assembly including:

a left rear wheel and a right rear wheel, each said rear wheel located at said rear end of said wheelchair, said left rear wheel located on said left side of said wheelchair, and said right rear wheel located on said right side of said wheelchair, said rear wheels larger than said front wheels;

a rear camber tube having a left and a right portion, each said portion having a left and a right end, said left end of said left portion of said rear camber tube connected to said left rear wheel, said right end of said right portion of said rear camber tube connected to said right rear wheel;

an axle extending through said camber tube, said axle having a left and a right end, said left end of said axle attached to said left rear wheel, and said right end of said axle attached to a said right rear wheel; and, a swing arm pivotally attached to said second portion of said frame assembly, said swing arm including:

a left and a right shock arm, each of said shock arms having a forward end and a rear end, said rear end of said left shock arm extending inwardly and forwardly from said left portion of said rear camber tube at a point near said left end of said left portion of said rear camber tube, said rear end of said right shock arm extending inwardly and forwardly from said right portion of said rear camber tube at a point near said right end of said right portion of said rear camber tube;

a left and a right pivot arm, each of said pivot arms having a front and a rear end, said left pivot arm extending forwardly from said left shock arm, said right pivot arm extending forwardly from said right shock arm;

a spreader bar extending between said front end of said left pivot arm and said front end of said right pivot arm;

a pivot arm shock mount including an inward projection from each of said pivot arms, each inward projection having a hole for receiving a latching device, said upper end of said pneumatic cylinder attached to said projections by a latching device extended through said holes in said upper end of said pneumatic cylinder and said holes in said projections; and, a swing arm pivot including a latching device passing through holes in said left pivot arm, said second portion of said frame assembly, and said right pivot arm; and, a chair assembly.

19. The wheelchair of claim 18 wherein said chair assembly includes:

a seat rack mounted on top of said seat mount, said seat rack including a left and a right tubular member;

a chair frame including a left and a right horizontal portion resting on and slidably engaged with said left and right members of said seat rack, said chair frame further including left and right back members extending vertically from said horizontal members, said left and right back members attached to each other at their upper ends by a seat back top;

a plurality of seat sleeves, said seat sleeves engage the horizontal portions of said chair frame and said tubular members of said seat rack, each said seat sleeve having a set screw which can be loosened to allow the sliding of said horizontal portions relative to said seat rack tubular members;

pushbars attached to both ends of said seat back top; and material stretched across said horizontal portions of said chair frame, and additional material stretched across said back members of said chair frame.

20. The wheelchair of claim 18 wherein said tubular frame assembly further includes a footrest mounted on top of said main frame member, said footrest including a rigid plate with a fabric cover, said footrest slidably fastened to said frame member and held in place by a fastener strap, said footrest further having adjustable footstraps.

* * * * *